US009988580B2

(12) United States Patent
Randal

(10) Patent No.: US 9,988,580 B2
(45) Date of Patent: Jun. 5, 2018

(54) SYSTEM AND METHOD FOR REMOVING HYDROGEN SULFIDE FROM OILFIELD EFFLUENTS

(71) Applicant: Amperage Energy Inc., Cochrane (CA)

(72) Inventor: Chad Allen Randal, Cochrane (CA)

(73) Assignee: Amperage Energy Inc., Cochrane, AB (CA)

( * ) Notice: Subject to any disclaimer, the term of this patent is extended or adjusted under 35 U.S.C. 154(b) by 337 days.

(21) Appl. No.: 14/256,179

(22) Filed: Apr. 18, 2014

(65) Prior Publication Data

US 2015/0299582 A1 Oct. 22, 2015

(51) Int. Cl.

| | |
|---|---|
| ***C10G 29/02*** | (2006.01) |
| ***C10G 29/20*** | (2006.01) |
| ***C10G 21/20*** | (2006.01) |
| ***C10G 29/04*** | (2006.01) |
| ***C10G 31/06*** | (2006.01) |
| ***C10G 53/04*** | (2006.01) |
| ***C10G 7/00*** | (2006.01) |
| ***C10G 21/08*** | (2006.01) |

(52) U.S. Cl.

CPC ..... *C10G 29/02* (2013.01); *C10G 7/00* (2013.01); *C10G 21/08* (2013.01); *C10G 21/20* (2013.01); *C10G 29/04* (2013.01); *C10G 31/06* (2013.01); *C10G 53/04* (2013.01); *C10G 2300/202* (2013.01)

(58) Field of Classification Search

CPC .. C10G 21/08; C10G 21/20; C10G 2300/202; C10G 29/02; C10G 29/04; C10G 31/06; C10G 53/04; C10G 7/00

See application file for complete search history.

(56) References Cited

U.S. PATENT DOCUMENTS 3,789,105 A * 1/1974 Tippmer ..... C10K 1/12 423/234
3,898,058 A 8/1975 McGill
4,486,299 A * 12/1984 Kettinger ..... B01D 3/38 208/347

(Continued)

FOREIGN PATENT DOCUMENTS

| | | |
|---|---|---|
| CA | 1 278 732 | 8/1991 |
| CN | 203268749 | 11/2013 |
| EP | 432858 A1 | 3/1999 |

OTHER PUBLICATIONS

University of Oklahoma, ChE4253 "Flash Drum Design."*
Government of Alberta, Controlling the Explosion Hazard in Vessel, Tanks and Piping Systems, 2010, pp. 1-11.*

*Primary Examiner* — Renee Robinson
*Assistant Examiner* — Derek N Mueller
(74) *Attorney, Agent, or Firm* — Cesari and McKenna, LLP

(57) ABSTRACT

Mobile treatment systems and methods for use in removing hydrogen sulfide from oilfield effluents. The systems and methods use a pre-treatment subsystem, a vapor treatment subsystem and a treatment subsystem interconnected by a plurality of piping and valve subsystems. The systems and methods are not dependent on pH and may operate at temperatures as low as −20° C. The systems are easily transported to, and readily assembled at a site and are inexpensive, simple, quick, and extremely effective at removing large-scale quantities of hydrogen sulfide from oilfield effluents.

14 Claims, 5 Drawing Sheets

(56) References Cited

U.S. PATENT DOCUMENTS

| | | | | |
|---|---|---|---|---|
| 4,548,708 | A | 10/1985 | Schwarzer et al. | |
| 4,551,158 | A | 11/1985 | Wagner et al. | |
| 4,853,002 | A | 8/1989 | Niedzwiecki et al. | |
| 5,347,004 | A * | 9/1994 | Rivers | B01D 53/52 544/180 |
| 8,246,813 | B2 | 8/2012 | Compton et al. | |
| 2011/0005999 | A1 * | 1/2011 | Randal | C02F 9/00 210/614 |
| 2011/0155646 | A1 | 6/2011 | Karas et al. | |

* cited by examiner

SYSTEM AND METHOD FOR REMOVING HYDROGEN SULFIDE FROM OILFIELD EFFLUENTS

BACKGROUND

Technical Field

This application relates generally to systems and methods used to remove contaminants from oilfield effluents, and more particularly, to systems and methods used to remove hydrogen sulfide from oilfield effluents.

Background Information

Oilfield effluents, including crude oil, produced water and flowback fracturing water, often contain dissolved hydrogen sulfide. Hydrogen sulfide is highly corrosive and may damage equipment used in oil and gas refining processes. Hydrogen sulfide is also toxic to humans and presents a significant health risk to workers in the oil and gas refining industry. Various transportation rules and guidelines may require that hydrogen sulfide concentrations not exceed certain levels.

Known methods used to remove hydrogen sulfide from oilfield effluents often include adding large amounts of scavenger chemicals or utilizing a stripping gas. These methods are often expensive, complex, time-consuming, unable to be easily transported to and from a site, and ineffective at removing large-scale quantities of hydrogen sulfide from the oilfield effluents. Moreover, utilizing a stripping gas may also remove low boiling point hydrocarbons, such as propane, isobutene, n-butane, isopentane, n-pentane, hexane and the like, which are desirable to retain in oilfield effluents such as crude oil. Thus, there is a continued need in the industry for systems and methods to remove hydrogen sulfide from oilfield effluents that are cheaper, simpler, faster, easily set-up and transported to and from a site, and more effective at removing large-scale quantities of hydrogen sulfide from oilfield effluents.

SUMMARY

The systems and methods for removing hydrogen sulfide from oilfield effluents described herein employ a pre-treatment subsystem, a vapor treatment subsystem and a treatment subsystem interconnected by a plurality of piping and valve subsystems. An oilfield effluent, including crude oil, produced water or flowback fracturing water, that is contaminated with hydrogen sulfide is pumped from a site to the pre-treatment subsystem and then to the treatment subsystem whereupon hydrogen sulfide is removed from the oilfield effluent by atomization and vacuum flashing. The vapor treatment subsystem treats the vapor released from the pre-treatment subsystem and the treatment system by removing hydrogen sulfide. The system is not dependent on pH and can operate at temperatures as low as about −20° C. The system is mobile and can be easily transported to and from a site and readily assembled at a site by interconnecting the subsystems.

BRIEF DESCRIPTION OF THE DRAWINGS

The embodiments described below refer to the accompanying drawings, of which.

DETAILED DESCRIPTION OF AN ILLUSTRATIVE EMBODIMENT

Mobile systems and methods for removing hydrogen sulfide from oilfield effluents are discussed in more detail below with crude oil as an example of an oilfield effluent.

Figure 1:
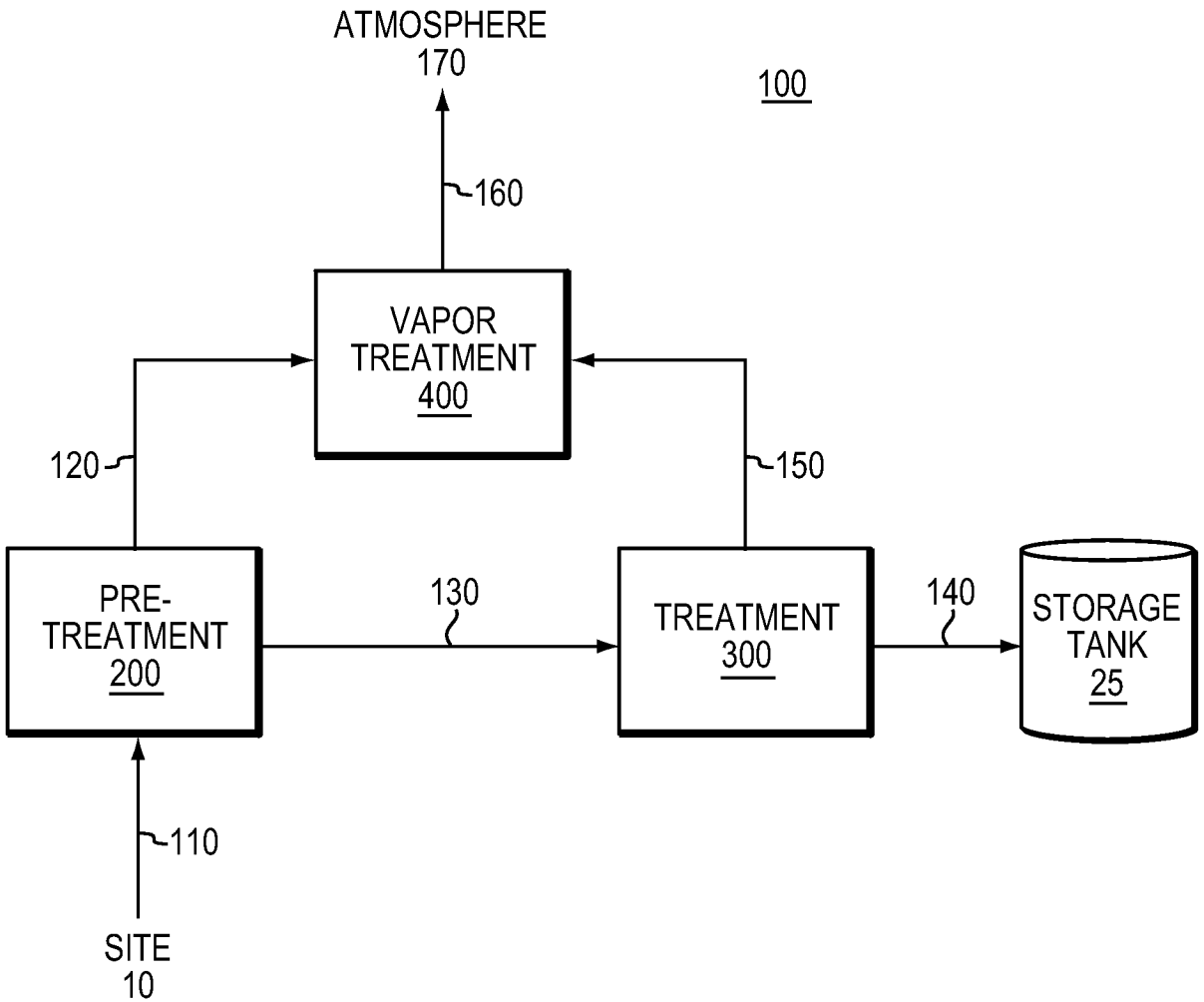
FIG. 1 is an overview of the systems and methods.

Referring to FIG. 1, a treatment system 100 for removing hydrogen sulfide from oilfield effluents is established proximate to a site 10. The site 10 may be a plant, refinery, truck, pipeline, contaminated water source, oil well, fracturing site or the like. The system 100 includes a pre-treatment subsystem 200, a treatment subsystem 300, a vapor treatment subsystem 400 and a storage tank 25 interconnected by a plurality of piping and valve systems (not shown in detail). Oilfield effluents, such as, but not limited to, crude oil 110 is pumped from the site 10 into the pre-treatment subsystem 200 where the crude oil is pre-treated by allowing hydrogen sulfide to passively vaporize out of the crude oil 110 to yield a first vapor 120 that is contaminated with hydrogen sulfide and a pre-treated solution, pre-treated oil 130. The first vapor 120 also contains, among other things, light chain hydrocarbons. The first vapor 120 is passively vented to the treatment subsystem 400 where the first vapor 120 is treated by removing hydrogen sulfide to yield a treated vapor, treated vapor 160. The treated vapor 160 is then vented, or otherwise released, into the atmosphere 170. In other embodiments, the first vapor 120 may alternatively be pumped to the treatment subsystem 300.

The pre-treated oil 130 is pumped by the pre-treatment subsystem 200 to the treatment subsystem 300 where the pre-treated oil 130 is atomized and vacuum flashed to produce a treated solution, treated oil 140. The second vapor 150 contains hydrogen sulfide removed from the pre-treated oil 130 during atomization and vacuum flashing. The second vapor 150 is pulled, or pumped, to the vapor treatment subsystem 400 and treated by removing hydrogen sulfide from the vapor to yield a treated vapor 160. The treated vapor 160 is then vented, or otherwise released, into the atmosphere. The treated oil 140 is pumped by the treatment subsystem 300 to a storage tank 25.

Figure 2:
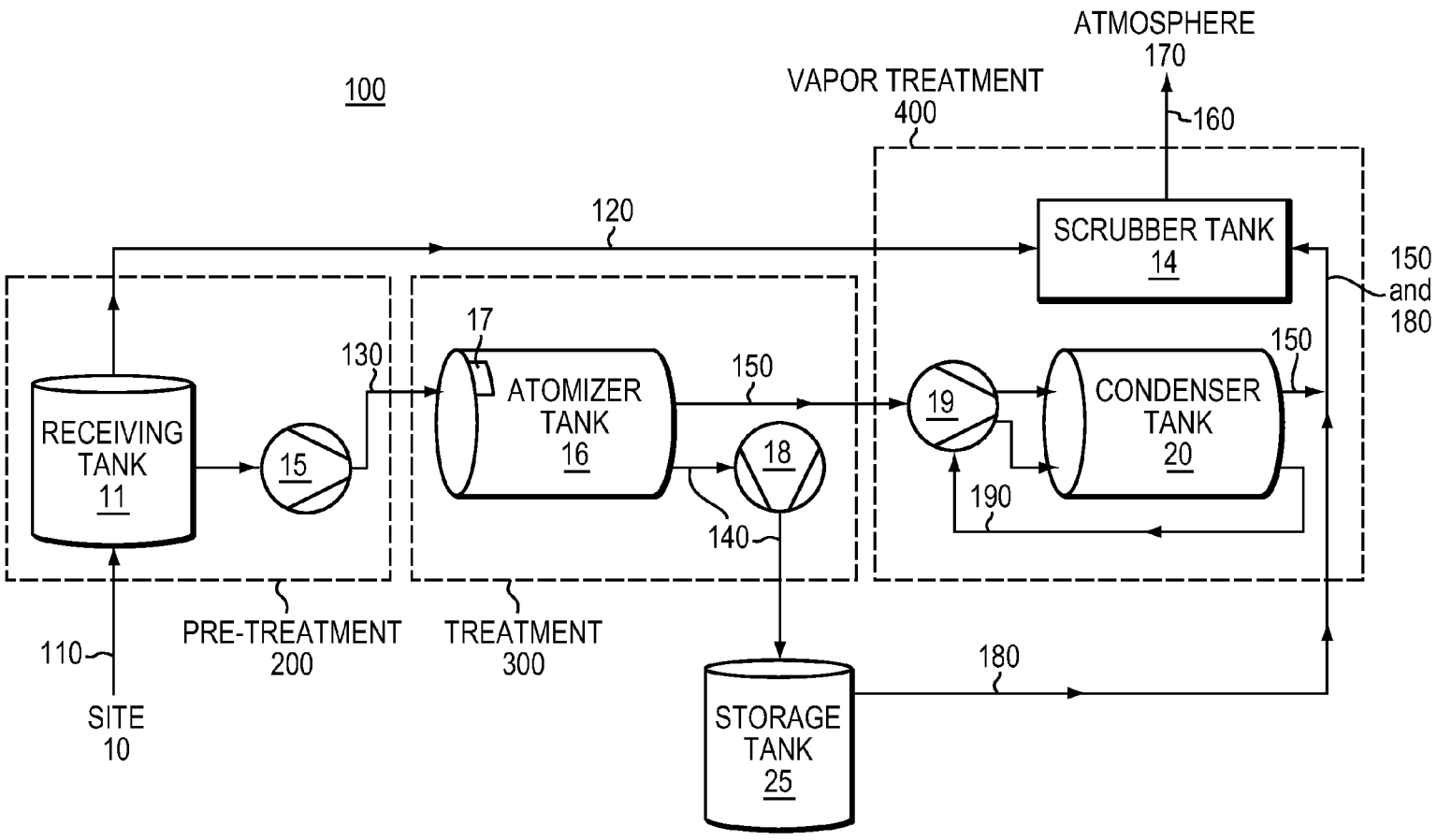
FIG. 2 is a functional diagram of a pre-treatment subsystem, a treatment subsystem and a vapor treatment subsystem of an illustrative embodiment.

Referring now to FIG. 2, the pre-treatment subsystem 200 contains a pump 15 and a receiving tank 11 for receiving the crude oil 110. The receiving tank 11 has a volume of about 240 $m^3$ and is maintained at atmospheric pressure. The crude oil 110 flows, or is pumped, into the receiving tank 11 from the site 10. The first vapor 120, containing, among other things, hydrogen sulfide, passively vaporizes out of the crude oil 110 into the receiving tank 11 and is passively vented out of the top of the receiving tank 11 to the vapor treatment subsystem 400. In other embodiments, the crude oil 110 in the receiving tank 11 may also be mixed to increase and/or stimulate vaporization of the first vapor 120 out of the crude oil 110. After approximately 30 $m^3$ of the receiving tank 11 is filled with the crude oil 110, the pump 15 pumps the pre-treated oil 130 out of the receiving tank 11 to the treatment subsystem 300. As the pre-treated oil 130 is pumped to the treatment subsystem 300, the crude oil 110 continues to flow, or be pumped, into the receiving tank 11 and the first vapor 120 continues to passively vent out of the top of the receiving tank 11.

As the first vapor 120 passively vaporizes out of the crude oil 110 in the receiving tank 11, the first vapor 120 is passively vented to a scrubber tank 14 of the vapor treatment subsystem 400 where the first vapor 120 is treated by passing, pumping or the like, the first vapor 120 through liquid triazine in the scrubber tank 14 to remove hydrogen sulfide. The treated vapor 160 is then vented, or otherwise released, into the atmosphere 170 by the scrubber tank 14. When the treated vapor 160 reaches a hydrogen sulfide level of about 10 ppm, or higher, during the process, the liquid triazine in the scrubber tank 14 is replaced with fresh liquid triazine. In other embodiments, liquid ammonia or ferric hydroxide may be used instead of liquid triazine.

In FIG. 2, the treatment subsystem 300 of the system 100 includes a pump 18 and an atomizer tank 16 containing an atomizing spray nozzle 17. The pump 15 of the pre-treatment subsystem 200 pumps the pre-treated oil 130 at a pressure of about 1-100 PSI into the atomizer tank 16 through the atomizing spray nozzle 17. As the pre-treated oil 130 is pumped through the atomizing spray nozzle 17, the pre-treated oil 130 is atomized and dispersed into fine droplets in the atomizer tank 16. In addition, the rapid change in pressure from 1-100 PSI outside the atomizer tank 16 to a vacuum of about 4 inHg inside the atomizer tank 16, vacuum flashes the atomized oil. Atomization and vacuum flashing of the pre-treated oil 130 stimulate the release of a second vapor 150, contaminated with hydrogen sulfide, from the pre-treated oil 130. The second vapor 150 is then pumped out of the atomizer tank 16 to the vapor treatment subsystem 400.

The atomizer tank 16 is housed or mounted on its own trailer bed and has a volume of about 60 $m^3$. In other embodiments, the size of the atomizer tank(s) may vary between about 20-80 $m^3$. The atomizer tank 16 is maintained at a vacuum of about 3-15 inHg, preferably about 4 inHg. The atomizing spray nozzle 17 consists of a 2" opening with a blast plate. In other embodiments, the associated pass-through rates or droplet sizes of the pre-treated solution passing through the atomizing spray nozzle may vary according to design. For example, the size of the openings of the atomizing spray nozzle may vary between about 1-3" or the shape of the atomizing spray nozzle itself may vary, such as a spiral-type atomizing spray nozzle.

In FIG. 2, the vapor treatment subsystem 400 includes a pump 19, a condenser tank 20 and the scrubber tank 14. The pump 19 pulls the second vapor 150 out of the atomizer tank 16 and pumps the vapor into a condenser tank 20. The condenser tank 20 is at atmospheric pressure and, as the vapor is pumped into the condenser tank 20, some of the second vapor 150 condenses to yield a condensate 190, which is a highly concentrated with hydrogen sulfide. Any remaining contaminated vapor 150 that has not condensed in the condenser tank 20 is passively vented out of the condenser tank 20 to the scrubber tank 14 where hydrogen sulfide is removed from the remaining contaminated vapor 150 by passing, pumping or the like, the vapor through liquid triazine. The treated vapor 160 is then vented into the atmosphere 170. The amount of condensate collected in the condenser tank 20 may vary depending on number of factors, including the amount of contaminants, such as hydrogen sulfide, in the crude oil.

After the pre-treated oil is atomized and vacuum flashed in the atomizer tank 16, the remaining treated oil condenses and collects in the bottom of the atomizer tank 16. This treated solution is then pumped out of the atomizer tank 16 as treated oil 140 by the pump 18 to the storage tank 25. While the treated oil is collected and stored in the storage tank 25 at atmospheric pressure, the oil may release additional residual vapor contaminated with hydrogen sulfide. This residual vapor is passively vented out, or pumped out, of the top of the storage tank 25 as a vapor 180 to the vapor treatment subsystem 400. The vapor treatment subsystem then removes hydrogen sulfide from this contaminated vapor in the scrubber tank 14 by passing, pumping or the like, the vapor through a liquid triazine solution. This decontaminated vapor is then released into the atmosphere 170 as the treated vapor 160. In other embodiments, the decontaminated vapor may be collected or flared off.

In FIG. 2, the pump 19 is configured to pump the second vapor 150 from the atomizer tank 16 into the condenser tank 20 and circulate the condensate 190 out of, and back into, the bottom of the condenser tank 20. As shown in more detail in FIG. 3, the circulation of the condensate 190 out of, and back into, the condenser tank 20 by the pump 19 creates and maintains a vacuum in the atomizer tank 16 and pumps the second vapor 150 from the atomizer tank 16 to the condenser tank 20.

Figure 3:
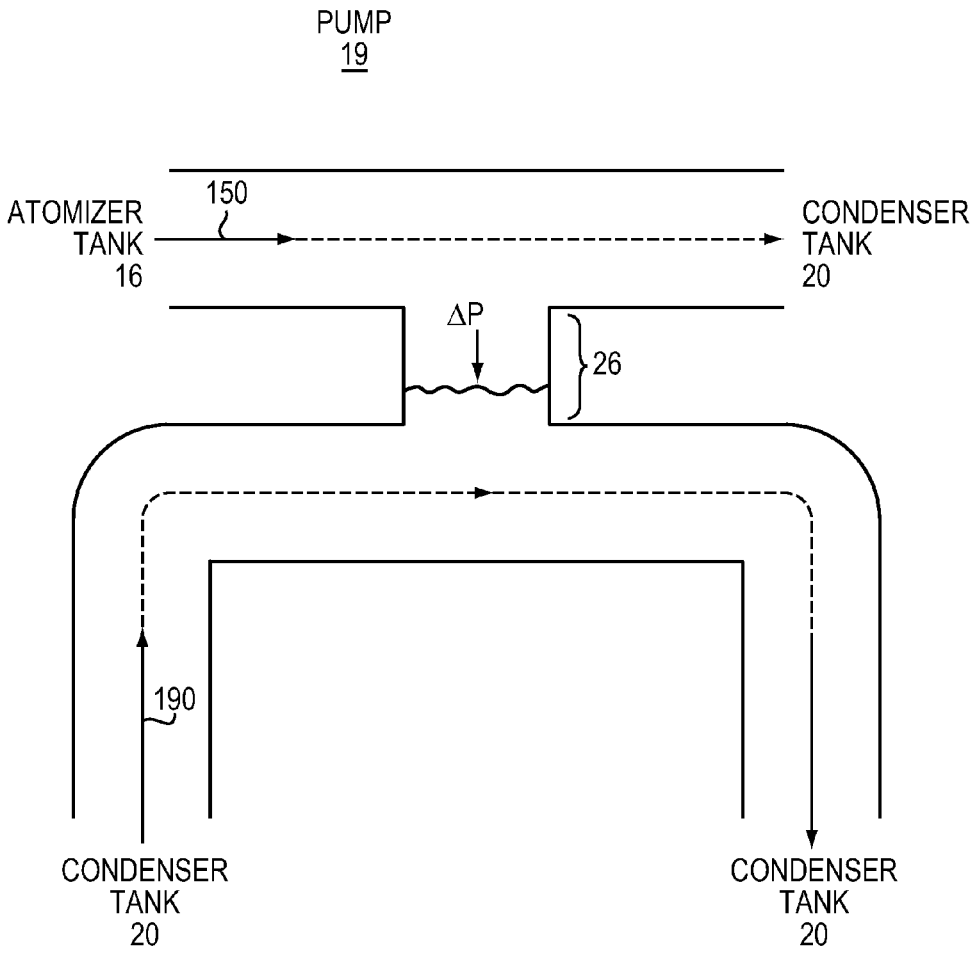
FIG. 3 is an enlarged section of a portion of a pump 19 of the vapor treatment subsystem of an illustrative embodiment.

Referring to FIG. 3 in more detail, the condensate 190 flows past a junction 26 of the pump 19 to generate an intense pressure differential between the junction of the pump 19 and the atomizer tank 16. This pressure differential creates and maintains the intense vacuum in the atomizer tank 16 and pumps the second vapor 150 from the atomizer tank 16 to the condenser tank 20. In other embodiments, a vapor pump may be used instead of pump 19 to either pump the second vapor 150 from the atomizer tank 16 into the condenser tank 20, or pull the second vapor 150 from the atomizer tank through the condenser tank 20. If the vapor pump is configured to pump the second vapor 150 into the condenser tank 20 from the atomizer tank 16, the condenser tank 20 is at or near atmospheric pressure. If the vapor pump is configured to pull the second vapor 150 through the condenser tank 20, the condenser tank 20 is at vacuum.

Figure 4:
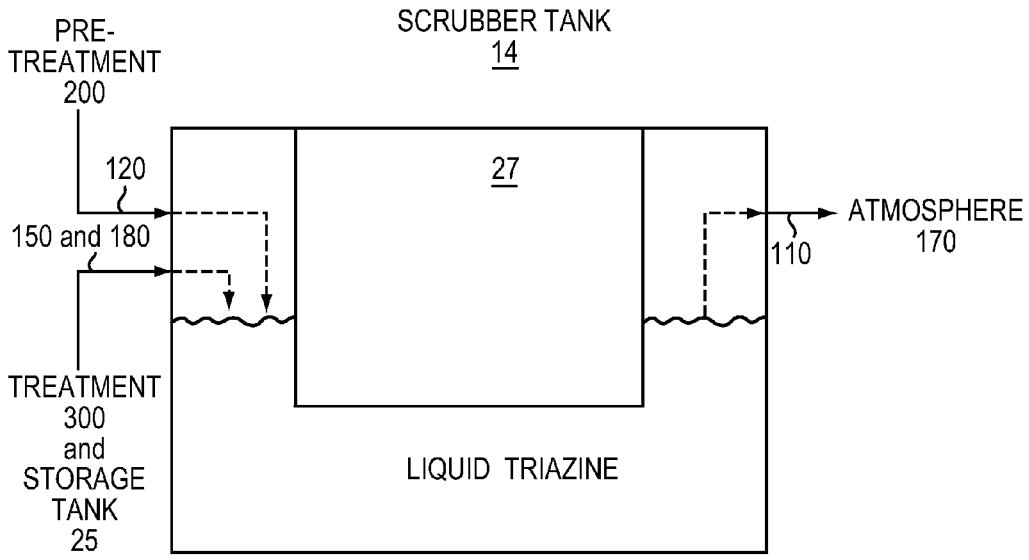
FIG. 4 is a functional diagram of a scrubber tank 14 of the vapor treatment subsystem of an illustrative embodiment.

In FIG. 4, the scrubber tank 14 of the vapor treatment subsystem 400 contains liquid triazine. The first vapor 120, the second vapor 150 and the vapor 180 are vented or pumped to the scrubber tank 14. The first vapor 120, the second vapor 150 and the vapor 180 are then passed, pumped or otherwise pulled, into the scrubber tank 14, under a unit 27 and through the liquid triazine in the scrubber tank 14. As the first vapor 120, the second vapor 150 and the vapor 180 pass through the liquid triazine in the scrubber tank 14, hydrogen sulfide is removed, or stripped, from the first vapor 120, the second vapor 150 and the vapor 180. The treated vapor 160 is then vented into the atmosphere 170.

Figure 5:
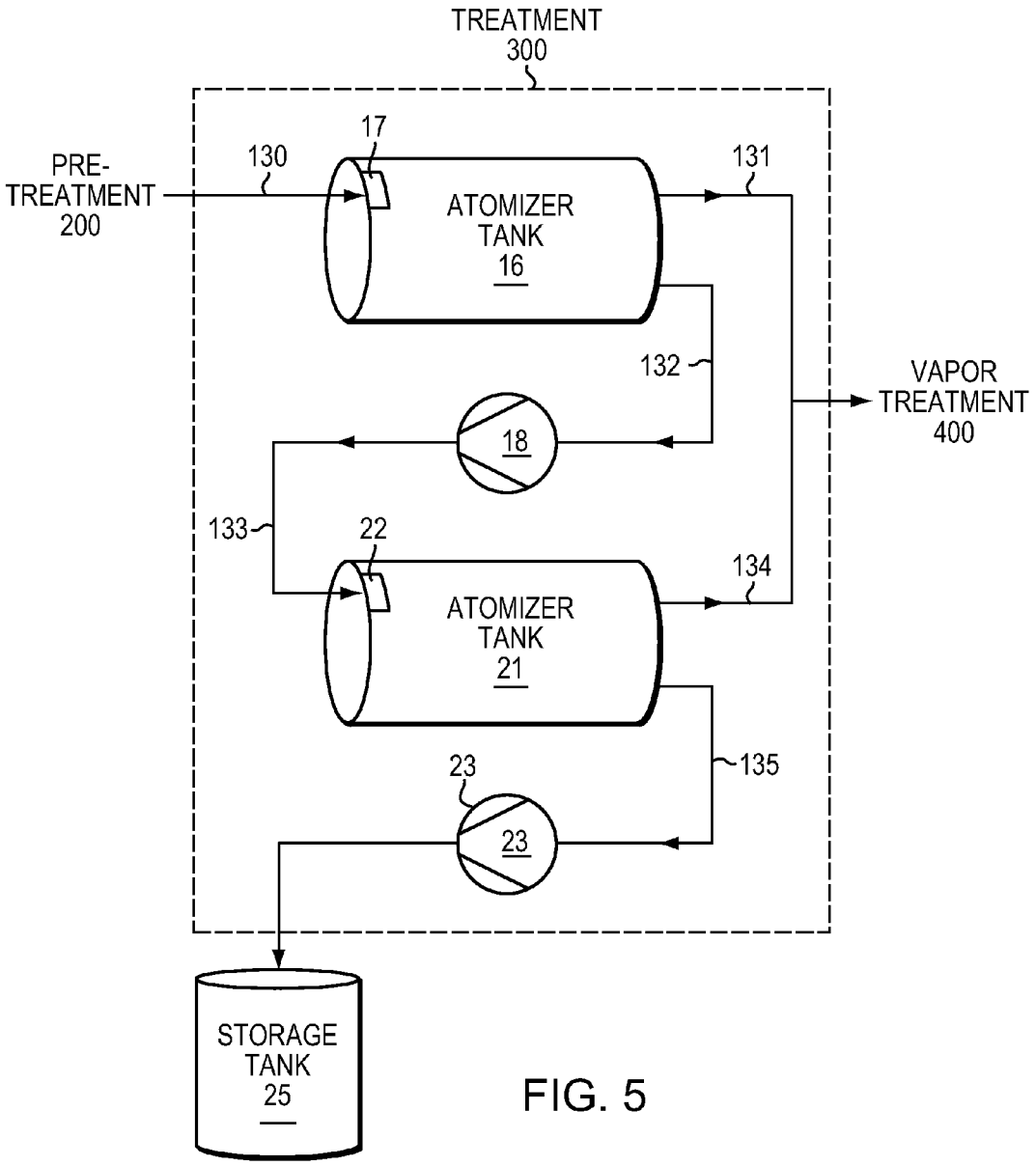
FIG. 5 is a functional diagram of the treatment subsystem of an illustrative embodiment.

Referring now to FIG. 5, the treatment subsystem 300 may contain a first and a second atomizer tank arranged in a series. The pre-treatment subsystem 200 pumps the pre-treated oil 130 through the atomizer spray nozzle 17 into the first atomizer tank 16. The atomizer spray nozzle 17 atomizes the pre-treated oil 130 by dispersing the oil into fine droplets. The pre-treated oil 130 is also vacuum flashed in the first atomizer tank 16 as the pre-treated oil 130 is pumped at 1-100 PSI into the first atomizer tank 16, which is maintained at a vacuum of about 3-15 inHg, preferably at about 4 inHg. Atomization and vacuum flashing release a hydrogen sulfide contaminated vapor 131 from the pre-treated oil 130. The contaminated vapor 131 is pulled out of the first atomizer tank 16 and treated by the vapor treatment subsystem 400.

The atomization of the pre-treated oil 130 in the first atomizer tank 16 creates fine droplets of treated oil which collect in the bottom of the first atomizer tank 16 as a first treated oil 132. The first treated oil 132 is then pumped out of the bottom of the first atomizer tank 16 by a pump 18 at a pressure of 1-100 PSI into a second atomizer tank 21 through an atomizer spray nozzle 22, consisting of a 2" opening with a blast plate. The atomizer spray nozzle 22 atomizes the first treated oil 132 into fine droplets in the second atomizer tank 21. The first treated oil 132 is also vacuum flashed in the second atomizer tank 21, which is maintained at a vacuum of approximately 3-15 inHg, preferably about 4 inHg. In other embodiments, the second atomizer tank 21 may be at a different pressure than the first atomizer tank 16.

Atomization and vacuum flashing of the first treated oil 132 in the second atomizer tank 21 release a contaminated vapor 134 containing additional hydrogen sulfide released from the first treated oil 132. The contaminated vapor 134 is pumped out of the second atomizer tank 21 and treated by the vapor treatment subsystem 400. The fine oil droplets created during atomization in the second atomizer tank 21 collect in the bottom of the second atomizer tank 21 as a second treated oil 135. The second treated oil 135 is pumped out of the second atomizer tank 21 to the storage tank 25 by a pump 23.

Depending on the application, the atomizer tank(s) of the embodiments may also be configured to recycle and re-treat the treated oil collected in the bottom of the atomizer tank(s). For example, in FIG. 2, the flow of pre-treated oil 130 from the receiving tank 11 to the atomizer tank 16 may be stopped by operation of a valve unit (not shown) and the treated oil 140 may be pumped back into the atomizer tank 16 by the pump 18 through the atomizer spray nozzle 17 to further atomize and vacuum flash the treated oil 140 and remove additional hydrogen sulfide. This re-treated oil may then be pumped to the storage tank 25 by operation of the pump 18. The treated oil 140 may also be continually re-treated to achieve a desired level of hydrogen sulfide in the treated oil. In other embodiments, the treated oil may be pumped directly from the bottom of the atomizer tank(s) into the pre-treated oil stream before the pre-treated oil is treated in the atomizer tank(s). Direct injection of the treated oil into the pre-treatment oil stream may further stimulate the release of hydrogen sulfide from the pre-treated oil in the atomizer tank(s).

In other embodiments, the number and setup of the components of the subsystems may vary depending on the particular parameters of the treatment methods and attributes of the oilfield effluent. For example, additional atomizer tanks of differing volume may be employed, depending on various parameters and needs of the systems, including the level of contaminants, such as hydrogen sulfide, in the oilfield effluent. Other embodiments may employ additional atomizer tanks in a series within the treatment subsystem 300 or each additional atomizer tank may simultaneously receive oilfield effluent directly from the pre-treatment subsystem 200. Additional storage tanks of varying volume may also be utilized. Depending on the amount and type of particulate in the oilfield effluent, other embodiments may include a filtration unit with filters and a backwashing subsystem as part of the pre-treatment subsystem 200. This filtration unit may help prevent any downstream clogging or damage to the systems. One or more additional receiving tanks may also be used to pre-treat the oilfield effluent.

The atomizer tank(s) may also be maintained at atmospheric pressure. In such embodiments, "sweet" gas or nitrogen gas is continuously pumped into the atomizer tank(s) to flush out vapor contaminated with hydrogen sulfide that is released during atomization. The "sweet" gas (or nitrogen gas) and flushed-out contaminated vapor is then pumped, or passively vented, to the vapor treatment subsystem 400 for removal of hydrogen sulfide. In other embodiments, "sweet" gas or nitrogen gas is intermittently pumped into the atomizer tank(s) while the atomizer tank(s) is/are under pressure to sweep and flush out contaminated vapor from the atomizer tank(s).

The treatment subsystem 300 may optionally contain one or more interconnected chemical storage units for the addition of chemicals into the systems. For example, the chemical storage units may contain hydrogen sulfide scavenging chemicals such as triazine or triazine-based chemicals, copper carbonate, hydrogen peroxide, zinc carbonates or oxides, ammonium salts, aldehydes (e.g. acrolein), or other amine-based scavengers. These hydrogen sulfide scavengers may be added to the oilfield effluent prior to treatment in the atomizer tank(s), after treatment in the atomizer tank(s) or both. Various chemicals may also be added after atomization in one atomizer tank, but prior to atomization in another atomization tank. One or more mixers may be employed to mix chemicals added to the oilfield effluent in the receiving tank, with the pre-treated solution prior to treatment by the treatment subsystem or with the treated solution prior to storage in the storage tank.

In other embodiments, the vapor treatment subsystem 400 may include one or more vapor recovery subsystems to capture contaminated vapor released, vented or pumped from the pre-treatment subsystem, the treatment subsystem, or the treated oilfield effluent in the storage tank(s). These contaminated vapors may contain various energy-producing light chain hydrocarbons, such as methane, ethane, propane or butane, which may be stored for later use or transportation or may be re-introduced into a natural gas pipeline. The vapor treatment subsystem 400 may also include additional scrubber tanks to treat, for example, the first contaminated vapor from the pre-treatment subsystem separate from the second contaminated vapor from the treatment subsystem.

The systems are mobile and can be readily and easily transported to and assembled at a site. The systems and methods operate effectively at temperatures as low as −20° C. With regard to the treatment of crude oil, the systems and methods reduce the amount of light chain hydrocarbons released from the crude oil at low operational temperatures and a high quality treated oil output is achieved. For example, the system may operate at a temperature below the boiling point of butane, thus preserving butane in the treated oil. The systems and methods are also inexpensive, simple, quick, and extremely effective at removing large-scale quantities of hydrogen sulfide from oilfield effluents.

The foregoing description has been directed to specific embodiments. It will be apparent, however, that other variations and modifications may be made to the described embodiments with the attainment of some or all of their advantages. For instance, it is expressly contemplated that the embodiments described herein may include additional components, such as receiving tanks, atomizer tanks, condenser tanks, scrubber tanks or a combination thereof. Also, while a particular order of particular treatment methods have been shown and described, those skilled in the art will appreciate that other method orders, arrangements, orientations, and the like, may be used to treat oilfield effluents, such as crude oil, produced water or flowback fracturing water, and that the systems and methods described herein are merely illustrative embodiments. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A method for removing hydrogen sulfide from an oilfield effluent comprising:

pre-treating the oilfield effluent in a receiving tank by allowing hydrogen sulfide to passively vaporize out of the oilfield effluent in the receiving tank to produce a first vapor containing the hydrogen sulfide and a pre-treated solution;

receiving, from the receiving tank, the pre-treated solution at one or more atomizing tanks, wherein the receiving tank is interconnected to the one or more atomizing tanks utilizing one or more first pipes and one or more first valves;

atomizing the pre-treated solution within the one or more atomizing tanks utilizing one or more spray nozzles to produce a second vapor containing hydrogen sulfide and a treated solution;

receiving, from the one or more atomizer tanks, the second vapor at a condenser tank, wherein a condensate is produced in the condenser tank from the second vapor and the condenser tank is interconnected to the one or more atomizer tanks utilizing one or more second pipes and one or more second valves;

circulating, the condensate out of and back into the condenser tank utilizing a pump coupled to the condenser tank;

receiving, at a scrubber tank, the first vapor and the second vapor, wherein the scrubber tank is interconnected with the receiving tank utilizing one or more third pipes and one or more third values and wherein the scrubber tank is interconnected to the condenser tank utilizing one or more fourth pipes and one or more fourth valves;

removing, by the scrubber tank, hydrogen sulfide from the first and second vapors independently received at different times from the receiving tank and the one or more atomizer tanks; and collecting the treated solution in at least one storage tank interconnected with the one or more atomizer tanks utilizing one or more fifth pipes and one or more fifth valves.

2. The method of claim 1 further comprising vacuum flashing the pre-treated solution.

3. The method of claim 1 wherein the one or more atomizer tanks has a vacuum of 3-15 inHg.

4. The method of claim 1 wherein the oilfield effluent is crude oil.

5. The method of claim 1 further comprising adding hydrogen sulfide scavengers to the oilfield effluent prior to pre-treating or atomizing.

6. The method of claim 1 wherein the scrubber tank contains liquid triazine, liquid ammonia or a ferric hydroxide medium.

7. The method of claim 1 wherein the oilfield effluent is produced water.

8. The method of claim 2 further comprising flushing the one or more atomizer tanks with sweet gas, the one or more atomizer tanks being at atmospheric pressure.

9. The method of claim 1 further comprising maintaining a vacuum of approximately 4 inHg in the one or more atomizer tanks.

10. The method of claim 1 further comprising adding chemicals to the oilfield effluent before pre-treating or atomizing, the chemicals selected from a group consisting of: triazine, copper carbonate, hydrogen peroxide, zinc carbonates or oxides, ammonium salts, aldehyde and a mixture of chemicals of the group.

11. The method of claim 1 wherein the oilfield effluent is flowback fracturing water.

12. A system for removing hydrogen sulfide from an oilfield effluent comprising:

a receiving tank configured to produce a first vapor containing hydrogen sulfide and a pre-treated solution from the oilfield effluent, wherein the receiving tank is interconnected to one or more atomizer tanks utilizing one or more first pipes and one or more first valves and wherein the receiving tank is interconnected to a scrubber tank utilizing one or more second pipes and one or more second valves;

the one or more atomizer tanks including one or more spray nozzles configured to atomize the pre-treated solution to produce a second vapor containing hydrogen sulfide and a treated solution, wherein the one or more atomizer tanks are interconnected to a condenser tank utilizing one or more third pipes and one or more third valves and wherein the one or more atomizer tanks are interconnected to at least one storage tank utilizing one or more fourth pipes and one or more fourth valves;

the condenser tank configured to receive the second vapor from the one or more atomizer tanks and to produce a condensate in the condenser tank, wherein the condenser tank is interconnected to the scrubber tank utilizing one or more fifth pipes and one or more fifth valves;

a pump coupled to the condenser tank configured to circulate the condensate out of and back into the condenser tank;

the scrubber tank configured to receive the first vapor and the second vapor from the receiving tank and the condenser tank, the scrubber tank further configured to remove hydrogen sulfide from the first and second vapors; and the at least one storage tank configured to collect the treated solution from the one or more atomizer tanks.

13. The system of claim 12 wherein the oilfield effluent is crude oil, produced water, or flowback fracturing water.

14. The system of claim 12 wherein the at least one atomizer tank is configured to be maintained at a vacuum of approximately 3-15 inHg.

* * * * *